US009124038B2

(12) United States Patent
Yu

(10) Patent No.: US 9,124,038 B2
(45) Date of Patent: Sep. 1, 2015

(54) CONNECTOR HOLDER AND ELECTRONIC DEVICE WITH CONNECTOR HOLDER

(71) Applicant: Wistron Corporation, New Taipei (TW)

(72) Inventor: Ching-Jen Yu, New Taipei (TW)

(73) Assignee: WISTRON CORPORATION, New Taipei (TW)

( * ) Notice: Subject to any disclaimer, the term of this patent is extended or adjusted under 35 U.S.C. 154(b) by 84 days.

(21) Appl. No.: 14/164,396

(22) Filed: Jan. 27, 2014

(65) Prior Publication Data

US 2015/0111422 A1 Apr. 23, 2015

(30) Foreign Application Priority Data

Oct. 17, 2013 (TW) ..... 102219349 U

(51) Int. Cl.

| | |
|---|---|
| ***H01R 13/6582*** | (2011.01) |
| ***H01R 13/639*** | (2006.01) |
| ***H01R 13/627*** | (2006.01) |
| ***H01R 13/193*** | (2006.01) |
| *H01R 12/71* | (2011.01) |
| *H01R 13/6594* | (2011.01) |

(52) U.S. Cl.

CPC ..... *H01R 13/6582* (2013.01); *H01R 13/193* (2013.01); *H01R 13/6272* (2013.01); *H01R 13/6275* (2013.01); *H01R 13/639* (2013.01); *H01R 12/716* (2013.01); *H01R 13/6594* (2013.01)

(58) Field of Classification Search

USPC ..... 439/345, 346, 352, 353, 530.1, 79, 439/607.11, 607.13, 607.32, 607.35, 697, 4, 439/620.12, 620.15, 299, 328, 333

See application file for complete search history.

(56) References Cited

U.S. PATENT DOCUMENTS

| | | | | |
|---|---|---|---|---|
| 7,322,845 | B2 * | 1/2008 | Regnier et al. | 439/352 |
| 7,473,124 | B1 * | 1/2009 | Briant et al. | 439/352 |
| 8,231,400 | B2 * | 7/2012 | Phillips et al. | 439/357 |
| 2007/0232118 | A1 * | 10/2007 | Wu | 439/353 |

* cited by examiner

*Primary Examiner* — Abdullah Riyami
*Assistant Examiner* — Harshad Patel
(74) *Attorney, Agent, or Firm* — Muncy, Geissler, Olds & Lowe, P.C.

(57) ABSTRACT

A connector holder and electronic device with the connector holder are disclosed. The connector holder for providing a connection between a connector plug and a connector includes two ground springs. The connector holder includes a main body and a moving member, wherein the main body connects with the connector and includes a first plate. The first plate is disposed on the two ground springs. The moving member is disposed in the main body and moves relative to the main body. The moving member includes a moving plate with two engaging convex points, wherein when the moving member connects with the main body, the moving plate is disposed between the first plate and the two ground springs. When the moving plate moves along a first direction such that the two engaging convex points touch the two ground springs, the connector plug is fixed to the connector.

20 Claims, 6 Drawing Sheets

CONNECTOR HOLDER AND ELECTRONIC DEVICE WITH CONNECTOR HOLDER

BACKGROUND OF THE DISCLOSURE

1. Field of the Disclosure

The present disclosure relates to a connector holder and an electronic device with the connector holder; more particularly, it relates to a connector holder for keeping a connector plug connected with a connector and an electronic device having the same.

2. Description of the Related Art

Nowadays, USB (Universal Serial Bus) is the most widely used transmission interface for transmitting data, and almost every electronic device on the market is equipped with USB connectors for connecting with USB drives for transmitting data or charging the electronic device. In general, there are two ground springs disposed on every USB connector. After a USB drive connects with a USB connector, the two ground springs are designed to gently touch the two square holes of the USB drive. However, the force applied to the USB drive is inadequate to establish a connection between the USB drive and the USB connector. Therefore, the connection between the USB connector and the USB drive may loosen or fail during operation and thus cause the failure of the USB drive, which is not convenient for users.

Therefore, there is a need to provide a connector holder and an electronic device with the connector holder for providing a connection between a connector plug, e.g., that of a USB drive, and a connector to overcome the problem that occurs when the connection between the connector plug and the connector loosens or fails during operation.

SUMMARY OF THE DISCLOSURE

It is an object of the present disclosure to provide a connector holder for providing a connection between a connector plug and a connector.

It is another object of the present disclosure to provide an electronic device with the connector holder.

In order to achieve the above objects, the connector holder of the present disclosure is for providing a connection between a connector plug and a connector, wherein the connector includes two ground springs. The connector holder includes a main body and a moving member, wherein the main body is for connecting with the connector. The main body includes a first plate disposed on the two ground springs. The moving member is disposed in the main body and is capable of moving relative to the main body. The moving member includes a moving plate with two engaging convex points, wherein when the moving member connects with the main body, the moving plate is disposed between the first plate and the two ground springs. When the moving plate moves along a first direction such that the two engaging convex points touch the two ground springs of the connector, the connector plug is fixed to the connector.

The present disclosure further provides an electronic device with the connector holder. The electronic device includes a circuit board, a connector, and a connector holder. The connector holder includes a main body and a moving member, wherein the main body is applied to connect with the connector and the main body comprises a first plate. The first plate is disposed on the two ground springs. The moving member is disposed in the main body and is capable of moving relative to the main body. The moving member includes a moving plate with two engaging convex points, wherein when the moving member connects with the main body, the moving plate is disposed between the first plate and the two ground springs. When the moving plate moves along a first direction such that the two engaging convex points touch the two ground springs of the connector, the connector plug is fixed to the connector.

BRIEF DESCRIPTION OF THE DRAWINGS

The exemplary embodiment of the present disclosure will be understood more fully from the detailed description given below and from the accompanying drawings of the disclosure, which, however, should not be taken to limit the disclosure to the specific embodiment, but are for explanation and understanding only.

DETAILED DESCRIPTION OF THE PREFERRED EMBODIMENT

To facilitate understanding and to clarify the object, characteristics, and advantages of the present disclosure, the following specific embodiments and figures illustrating the present disclosure are presented as a detailed description.

Figure 1:
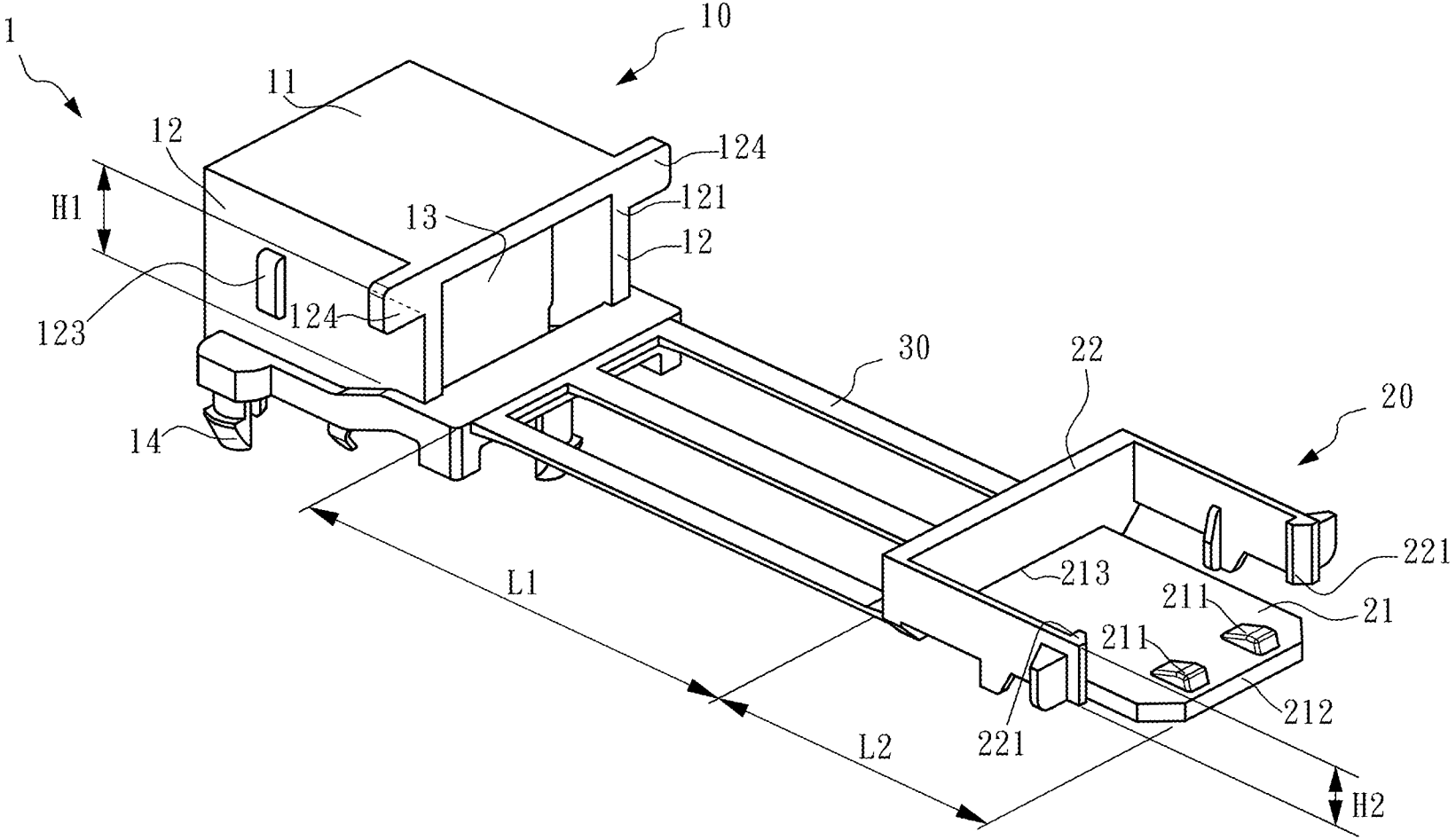
FIG. 1 is a schematic drawing of the connector holder of the present disclosure.
Figure 2:
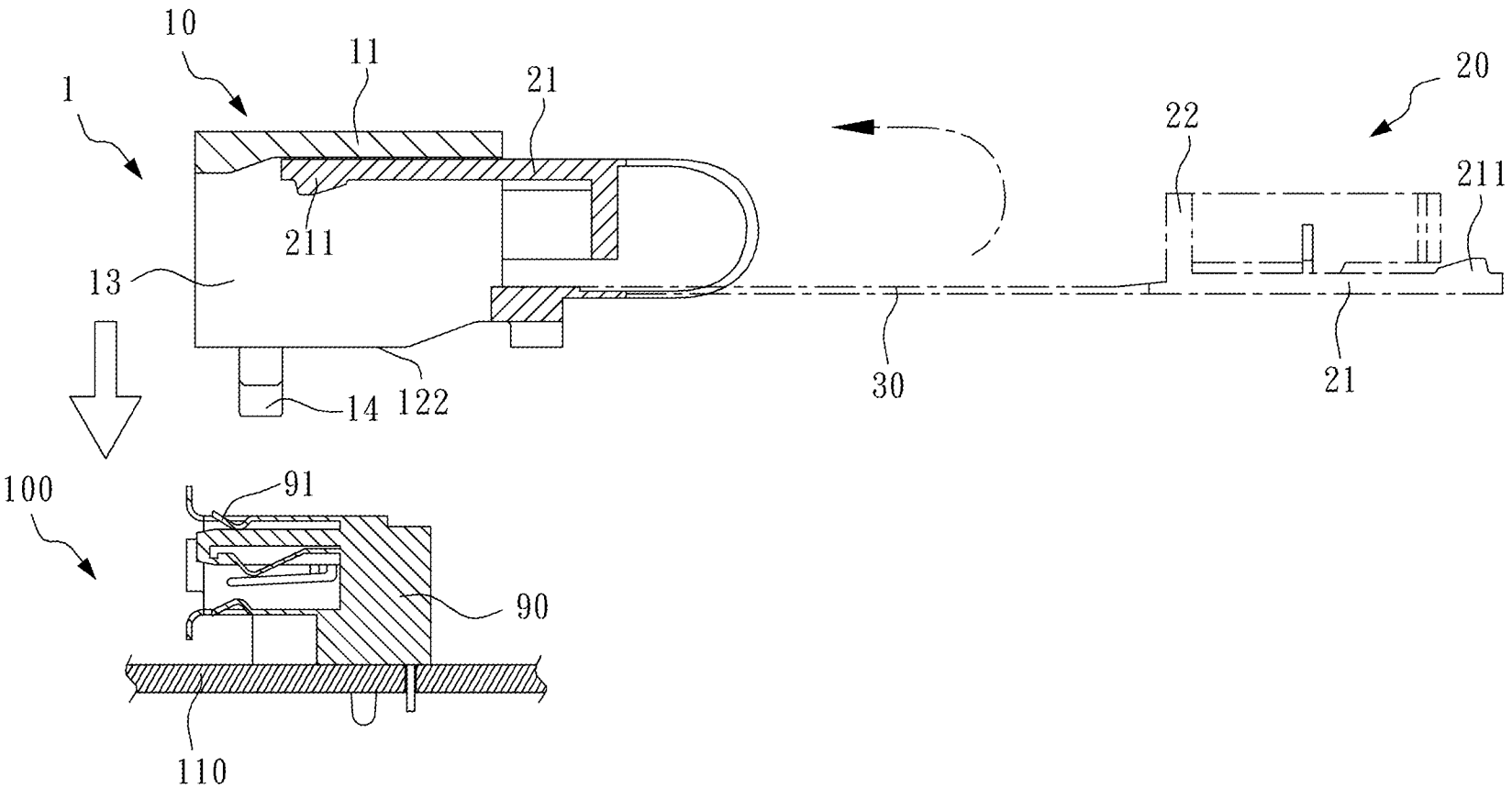
FIG. 2 illustrates one exploded perspective view of assembly of the connector holder with the electronic device of the present disclosure.
Figure 3:
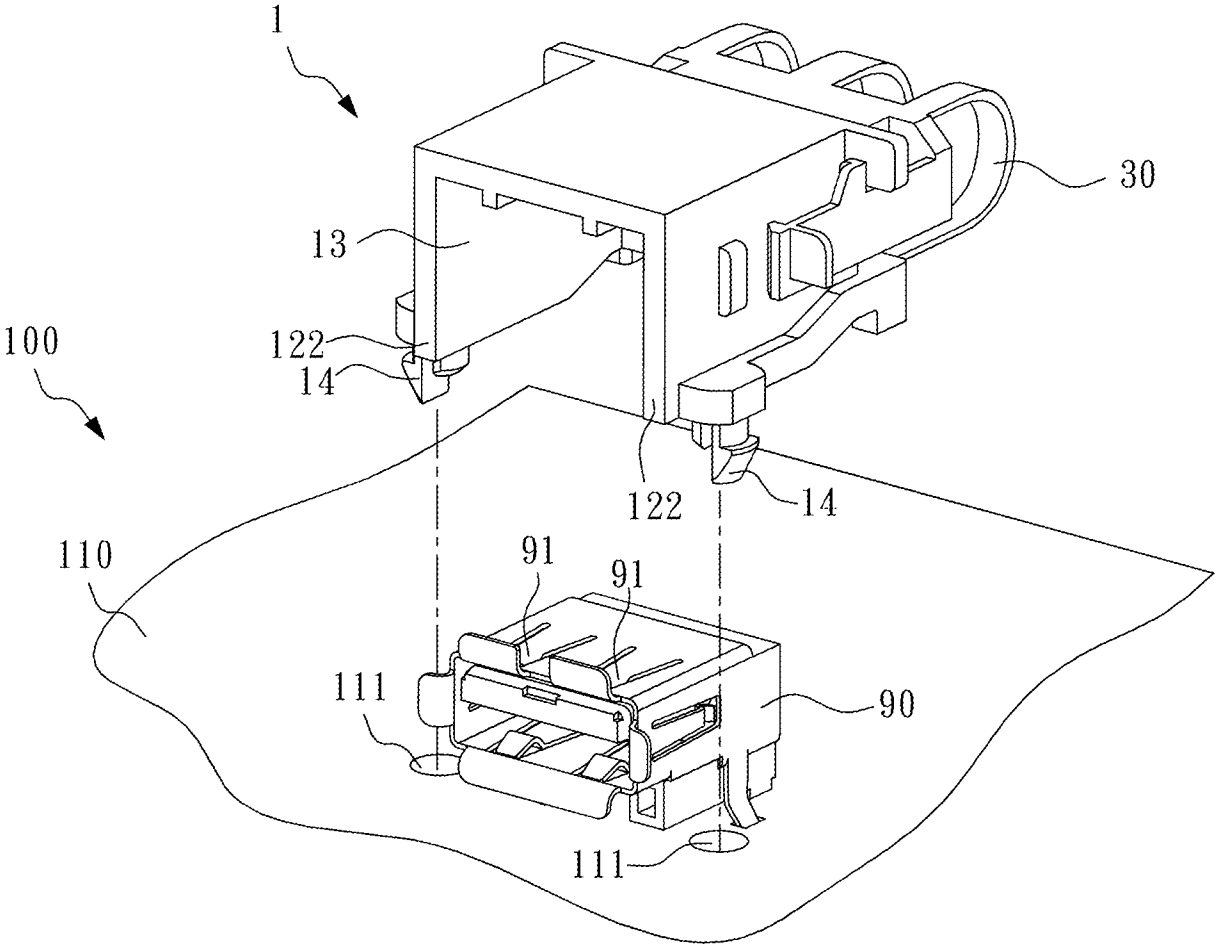
FIG. 3 illustrates another exploded perspective view of assembly of the connector holder with the electronic device of the present disclosure.
Figure 4:
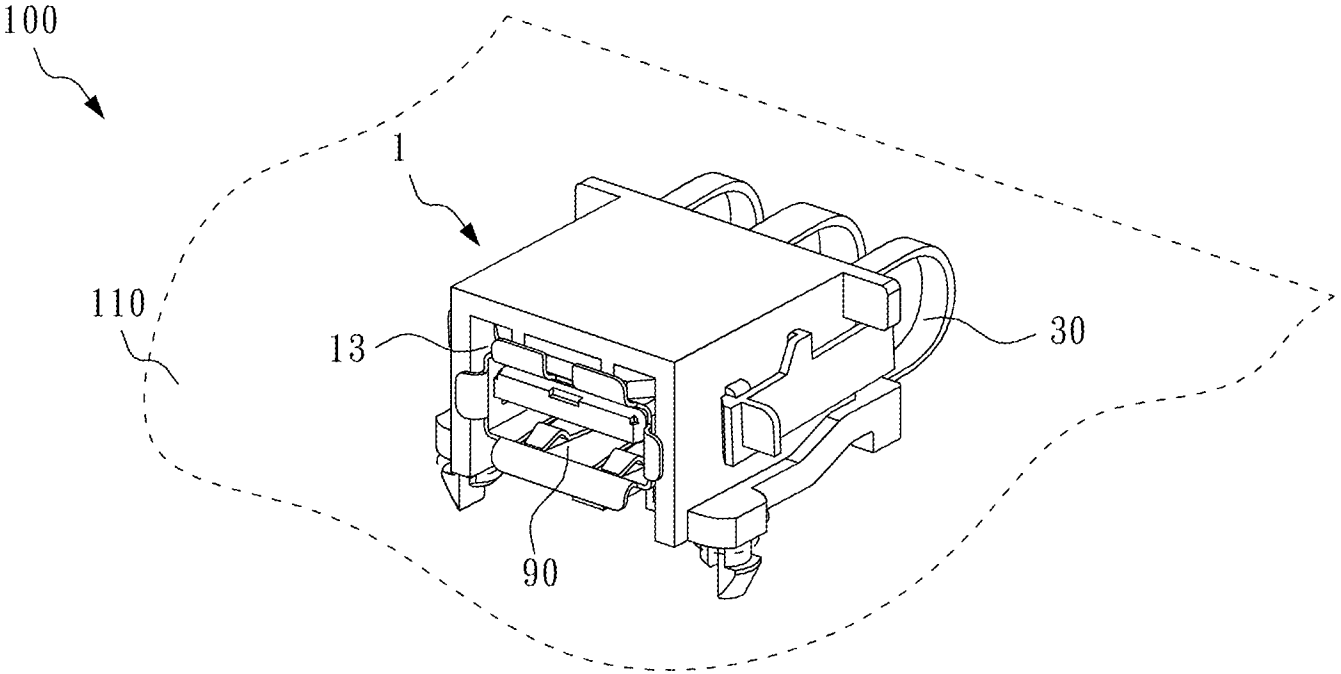
FIG. 4 is a schematic drawing of the electronic device of the present disclosure.

Please refer to FIG. 1 and FIG. 4, wherein FIG. 1 is a schematic drawing of the connector holder of the present disclosure; FIG. 2 illustrates one exploded perspective view of assembly of the connector holder with the electronic device of the present disclosure; FIG. 3 illustrates another exploded perspective view of assembly of the connector holder with the electronic device of the present disclosure; FIG. 4 is a schematic drawing of the electronic device of the present disclosure.

As shown in FIG. 1 to FIG. 4, the connector holder 1 of the present disclosure is disposed in an electronic device 100 and is connected with a connector 90. The connector holder 1 is for providing a connection between the connector 90 and a connector plug that is connected with the connector 90. The electronic device 100 can be a server, an industrial computer, or any electronic device with an easily-detached case that thus allows the connector holder 1 to be used. Furthermore, as shown in FIG. 3 and FIG. 4, the electronic device 100 includes a circuit board 110 and a plurality of connecting holes 111 disposed therein.

In the present embodiment, as shown in FIG. 1, the connector holder 1 includes a main body 10, a moving member 20, and a bending to portion 30. As shown in FIG, 2, the main body 10 is for connecting with the connector 90. The two ends of the bending portion 30 connect with the main body 10 and the moving member 20 respectively. Due to the design of the bending portion 30, the moving member 20 is capable not only of entering the main body 10 but also of moving relative to the main is body 10 after the bending portion 30 is bent. It is noted that the main body 10, the moving member 20, and the bending portion 30 of the present embodiment are formed as an integrated whole and that the connector holder 1 is made of a plastic material. In addition, the connector 90 that connects with the connector holder 1 of the present disclosure is the female component of a USB connector. As shown in FIG. 3, the connector 90 has two ground springs 91, and the two ground springs 91 are for gently contacting the two corresponding square holes located on general USB drives. It is noted that because USB connectors and USB drives are not the major focus of the present disclosure and the structure of a USB drive is also well known to those skilled in the art, a drawing illustrating the structure of a USB drive is omitted.

As shown in FIG. 1 and FIG. 2, the main body 10 includes a first plate 11, two second plates 12, and a plurality of connecting hooks 14. Each of the two second plates 12 includes a connecting end 121, an open end 122, a convex column 123, and a stopper 124. The connecting end 121 of the two second plates 12 connects with the two ends of the first plate 11 to form an accommodation space 13 for accommodating the connector 90. As shown in FIG. 3 and FIG. 4, each connecting hook 14 is disposed at the open end 122 respectively for connecting with the connecting hole 111 of the circuit board 110 such that the main body 10 is fixed on the circuit board 110 and the electronic device 100 of the present disclosure is thus formed.

The moving member 20 includes a moving plate 21 and an operation portion 22. As shown in FIG. I and FIG. 2, the moving plate 21 includes two engaging convex points 211, a first end 212, and a second end 213. The two engaging convex points 211 are disposed close to the first end 212, and the locations of the two engaging convex points 211 are corresponded to the two ground springs 91 of the connector 90. As shown in FIG. 2, when the moving member 20 is overturned and then enters the main body 10, the moving plate 21 enters the accommodation space 13 through a location underneath the first plate 11 and close to the connecting end 121; therefore, the moving plate 21 is disposed between the first plate 11 and the two ground springs 91. The operation portion 22 connects with the moving plate 21 at the second end 213, and the operation portion 22 comprises two oppositely-disposed hooks 221. After the moving plate 21 enters the accommodation space 13, the two hooks 221 can move between the convex column 123 and the stopper 124 if the operation portion 22 is pushed. As shown in FIG. 3, when the moving member 20 moves such that it touches the stopper 124, the moving member 20 stops moving accordingly to prevent the moving member 20 from detaching from the main body 10. When the moving member 20 moves and then touches the convex column 123, as shown in FIG. 4, the two hooks 221 are pushed to engage with the convex column 123 of the two second plates 12; the position of the moving member 20 relative to the main body 10 is thus fixed.

Figure 5:
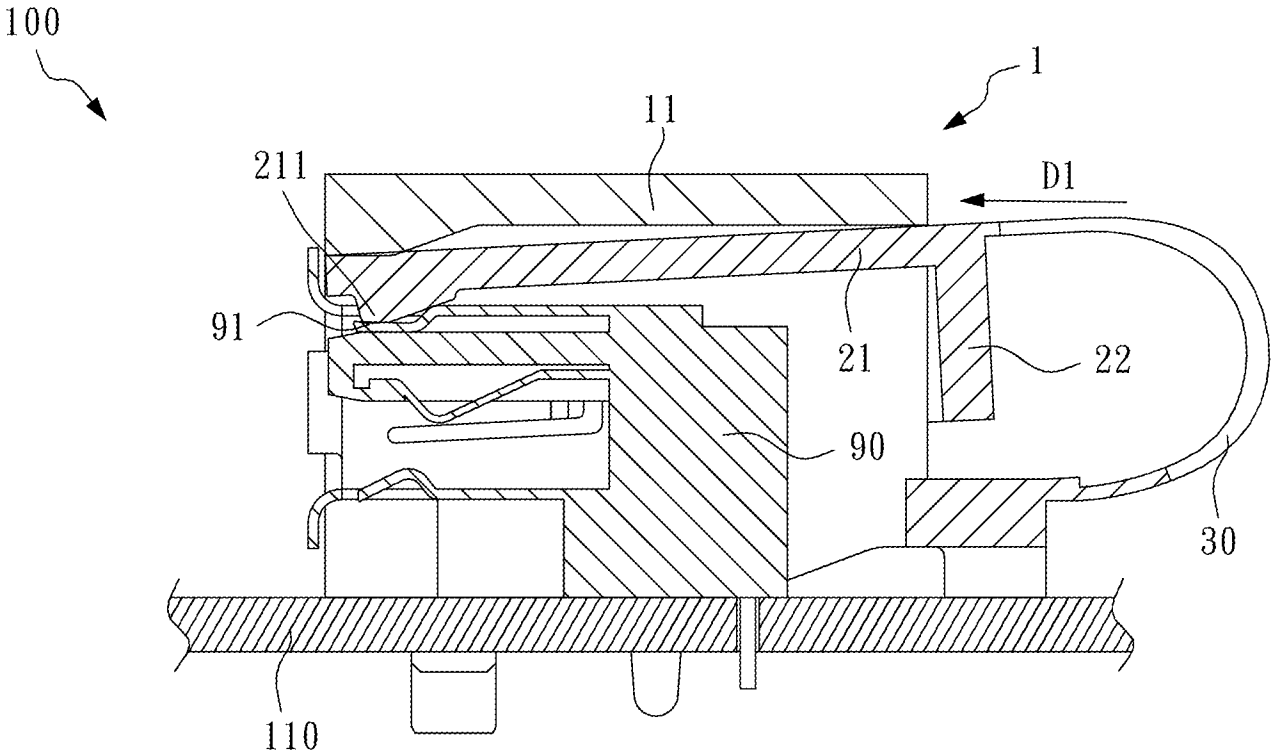
FIG. 5 is a schematic drawing illustrating the connector holder in contact with the connector ground spring.

Please refer to FIG. 1; the bending portion 30 has a length $L_1$, and the moving member 20 has a length $L_2$. In order to facilitate the overturning of the moving member 20, the proper lengths of the bending portion 30 and the moving member 20 are $L_2<L_1<2*L_2$. Furthermore, for allowing the moving plate 21 of the moving member 20 to enter the accommodation space 13 of the main body 10 smoothly after being overturned, the height $H_2$ of the operation portion 22 is less than the height $H_1$ of the main body 10. It is noted that, as shown in FIG. 1, the height $H_1$ is approximately between the height of the top end of the stopper 124 and the height of the bending portion 30. However, the height $H_1$ does not represent the total height of the main body 10, and the height $H_2$ is about 5 mm less than the height $H_1$. It is noted that the bending portion 30 is not the essential element of the connector holder 1 of the present disclosure. The moving member 20 can still move relative to the main body 10 to complete the performance of touching the two ground springs 91 even if the bending portion 30 is broken. Furthermore, the main body 10 and the moving member 20 of the connector holder 1 can be presented as two separate elements; i.e., the main body 10 does not have to be connected with the moving member 20 in advance. The assembly of the moving member 20 and the main body 10 of the connector holder 1 can be performed by technicians whenever necessary Please refer to FIG. 1 and FIG. 2 along with FIG. 5 and FIG. 6; FIG. 5 is a schematic drawing illustrating the connector holder touching the connector ground spring, and FIG. 6 is a schematic drawing illustrating the connector holder moving away from the connector ground spring.

As shown FIG. 5, when the connector holder 1 connects with the connector 90, the moving plate 21 is disposed between the first plate 11 and the two ground springs 91. When the operation portion 22 is pushed by a technician and the moving plate 21 moves along a first direction D1, the two engaging convex points 211 move along a direction toward the two ground springs 91 until the two engaging convex points 211 touch and press the corresponding ground springs 91. As a result, the ground springs 91 are pressed and moved downward to sink into the square holes of the connector plug. Consequently, the connector plug is fixed with the connector 90 and cannot be pulled out, and the problem of the prior art, that the connection between the connector and the connector plug may become loose during operation, can be overcome.

Figure 6:
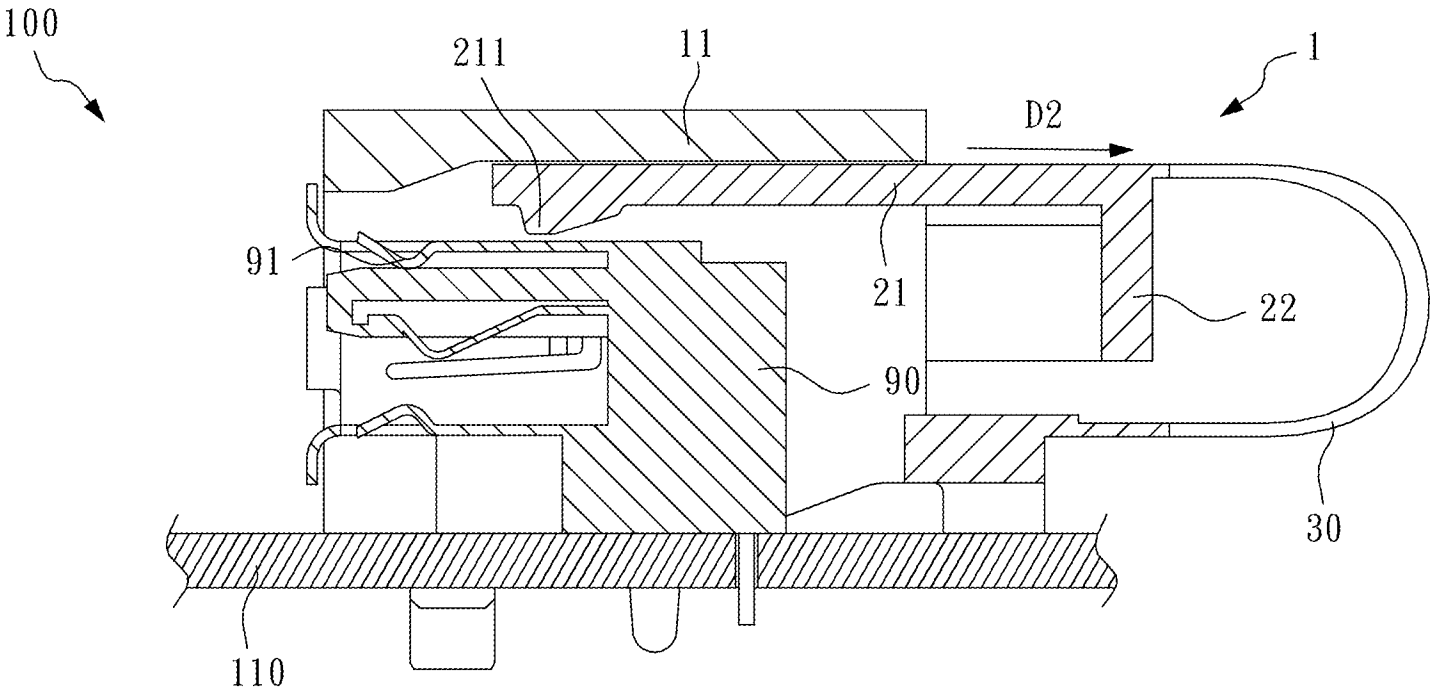
FIG. 6 is a schematic drawing illustrating the connector holder moving away from the connector ground spring.

As shown in FIG. 6, when the connector plug is to be pulled out from the connector 90, the technician needs only to pull the operation portion 22, and then the moving plate 21 moves along the second direction D2 accordingly. Thus, the two engaging convex points 211 move along a direction that is away from the two ground springs 91 to release the force applied to the two ground springs 91 by the two corresponding engaging convex points 211. Consequently, the two ground springs 91 return to a state of gently touching the square hole of the connector plug for allowing the technician to pull out the connector plug from the connector 90. As shown in FIG. 5 and FIG. 6, the first direction D1 and the second direction D2 are opposite directions.

Due to the design of disposing the moving member 20 in the main body 10 and allowing the moving member 20 to move inside the main body 10, the total volume of the connector holder 1 is compact and light. The total height of the main body 10 is reduced to less than 12.5 mm, and as a result, the connector holder 1 does not have to occupy much of the interior space of the electronic device 100. In addition, the structure of the connector holder 1 of the present disclosure is simple and is formed as an integrated whole to reduce the costs of opening molds and assembly; thus, the manufacturing cost can be reduced as well.

It is noted that the above-mentioned embodiments are only for illustration. It is intended that the present disclosure cover modifications and variations of this disclosure provided they fall within the scope of the following claims and their equivalents. Therefore, it will be apparent to those skilled in the art that various modifications and variations can be made to the structure of the present disclosure without departing from the scope or spirit of the disclosure.

What is claimed is:

1. A connector holder for providing a connection between a connector plug and a connector, wherein the connector comprises two ground springs, the connector holder comprising:

a main body, for connecting with the connector, the main body comprising a first plate disposed on the two ground springs; and a moving member, disposed in the main body and capable of moving relative to the main body, the moving member comprising a moving plate with two engaging convex points, wherein when the moving member connects with the main body, the moving plate is disposed between the first plate and the two ground springs; when the moving plate moves along a first direction such that the two engaging convex points touch the two ground springs, the connector plug is fixed to the connector.

2. The connector holder as claimed in claim 1, wherein when the moving plate moves along a second direction, the moving plate moves away from the two ground springs for releasing the connection between the connector plug and the connector.

3. The connector holder as claimed in claim 2, wherein the first direction and the second direction are opposite directions.

4. The connector holder as claimed in claim 2, the main body comprising two second plates and each of the two second plates comprising a connecting end and an open end, wherein the connecting ends of the two second plates connect with the two ends of the first plate respectively to form an accommodation space for accommodating the connector.

5. The connector holder as claimed in claim 4, the moving plate comprising a first end, wherein the two engaging convex points are disposed close to the first end; when the moving member connects with the main body, the moving plate enters the accommodation space through a location underneath the first plate and close to the connecting end.

6. The connector holder as claimed in claim 5, wherein the moving plate comprises a second end; the moving member comprises an operation portion, and the operation portion connects with the second end of the moving plate.

7. The connector holder as claimed in claim 6, wherein the operation portion comprises two oppositely-disposed hooks and each of the two second plates comprises a convex column for engaging with the two hooks respectively.

8. The connector holder as claimed in claim 7, wherein each of the two second plates comprises a stopper, disposed at the connecting end, for limiting a movement of the moving member.

9. The connector holder as claimed in claim 5, wherein the connector holder comprises a bending portion; two ends of the bending portion connect with the second end and the two second plates respectively; the moving member can be overturned relative to the main body for allowing the moving plate to enter the accommodation space through the location underneath the first plate and close to the connecting end.

10. The connector holder as claimed in claim 9, wherein the bending portion comprises a length $L_1$ and the moving member comprises a length $L_2$, wherein $L_2<L_1<2*L_2$.

11. An electronic device comprising:

a circuit board;

a connector, disposed on the circuit board, for connecting with a connector plug;

a connector holder, for providing a connection between the connector plug and the connector, the connector holder comprising:

a main body, for connecting with the connector, the main body comprising a first plate disposed on two ground springs of a connector; and a moving member, disposed in the main body and capable of moving relative to the main body, the moving member comprising a moving plate with two engaging convex points, wherein when the moving member connects with the main body, the moving plate is disposed between the first plate and the two ground springs; when the moving plate moves along a first direction such that the two engaging convex points touch the two ground springs, the connector plug is fixed to the connector.

12. The electronic device as claimed in claim 11, wherein when the moving plate moves along a second direction, the moving plate moves away from the two ground springs for releasing the connection between the connector plug and the connector.

13. The electronic device as claimed in claim 12, wherein the first direction and the second direction are opposite directions.

14. The electronic device as claimed in claim 11, the main body comprising two second plates and each of the two second plates comprising a connecting end and an open end, wherein the connecting end of the two second plates connects with the two ends of the first plate respectively to form an accommodation space for accommodating the connector.

15. The electronic device as claimed in claim 14, the moving plate comprising a first end, wherein the two engaging convex points are disposed close to the first end; when the moving member connects with the main body, the moving plate enters the accommodation space through a location underneath the first plate and close to the connecting end.

16. The electronic device as claimed in claim 15, wherein the moving plate comprises a second end; the moving member comprises an operation portion and the operation portion connects with the second end of the moving plate; the operation portion comprises two oppositely-disposed hooks and each of the two second plates comprises a convex column for engaging with the two hooks respectively.

17. The electronic device as claimed in claim 16, wherein each of the two second plates comprises a stopper, disposed at the connecting end, for limiting a movement of the moving member.

18. The electronic device as claimed in claim 15, wherein the connector holder comprises a bending portion; two ends of the bending portion connect with the second end and the two second plates respectively; the moving member can be overturned relative to the main body for allowing the moving plate to enter the accommodation space through the location underneath the first plate and close to the connecting end.

19. The electronic device as claimed in claim 18, wherein the bending portion comprises a length $L_1$ and the moving member comprises a length $L_2$, wherein $L_2<L_1<2*L_2$.

20. The electronic device as claimed in claim 11, the circuit board comprising a plurality of connecting holes and the main body comprising a plurality of connecting hooks, wherein each of the connecting hooks connects with the plurality of connecting holes respectively such that the main body is fixed on the circuit board.

* * * * *